United States Patent [19]

Lissoni

[11] Patent Number: 4,633,642

[45] Date of Patent: Jan. 6, 1987

[54] PRESSURE ROLLER DEVICE FOR LATERALLY RETAINING BOXES IN PACKAGING MACHINES WITH AUTOMATIC BOX FEED

[75] Inventor: Adelio Lissoni, Vedano Olona, Italy

[73] Assignee: S.I.A.T. Societa Internazionale Applicazioni Techniche S.p.A., Turate, Italy

[21] Appl. No.: 783,441

[22] Filed: Oct. 3, 1985

[30] Foreign Application Priority Data

Oct. 5, 1984 [IT] Italy ..... 23459/84[U]

[51] Int. Cl.[4] ..... B65B 7/16; B65B 51/06

[52] U.S. Cl. ..... 53/137; 493/117; 493/475

[58] Field of Search ..... 53/137, 374, 373; 493/475, 478, 117, 116

[56] References Cited

U.S. PATENT DOCUMENTS

| | | | |
|---|---|---|---|
| 2,135,806 | 11/1938 | Fermann et al. | 53/374 |
| 2,691,260 | 10/1954 | Schlemmer | 53/374 X |
| 3,302,365 | 2/1967 | Currie | 53/374 X |
| 3,975,887 | 8/1976 | Clymer | 53/373 |
| 4,086,744 | 5/1978 | Seragnoli | 53/137 |

*Primary Examiner*—James F. Coan

*Attorney, Agent, or Firm*—Young & Thompson

[57] ABSTRACT

A support device for a pressure roller, forming a lateral retainer and associated with the upper working head of a packaging machine, comprises a plate, essentially in the form of a circular sector, from which a support arm for the roller projects, the plate being mounted rotatable on a vertical pivot fixed to the machine working head assembly and cooperating with a position lock, the roller being carried at the end of said support arm by a vertical rotation pin.

3 Claims, 3 Drawing Figures

PRESSURE ROLLER DEVICE FOR LATERALLY RETAINING BOXES IN PACKAGING MACHINES WITH AUTOMATIC BOX FEED

BACKGROUND OF THE INVENTION

Automatic or semi-automatic packaging machines are known to comprise means for feeding the packaging boxes along a guided path, for the sealing thereof by means of adhesive tape.

For guiding the box at its base, a supporting roller table, conveying and/or taping means, and lateral retention means are normally provided, these latter being generally in the form of parallel rods fixed at a distance apart equal to the box width. For guiding the box at its top, an upper conveying and/or taping head is used, to which are associated lateral retention means, generally in the form of pressure rollers mounted idly on vertical pins. These rollers can be moved vertically together with the head, in relation to the height of the boxes to be sealed. Their positon can also be adjusted transversely in relation to the box width.

The present invention is concerned with the problem of adjusting the position of the pressure rollers associated to the upper head. One of the most known methods for obtaining this adjustment is to mount the pin of each pressure roller on a clamp slidable along a support rod, which is welded on to the upper guide head of the machine so as to project in a transverse direction from a position of the head which is set back in respect of the box feed direction.

Although generally used in packaging machines of this type, this arrangement has some drawbacks. Firstly, mounting the rod on the upper head in a set-back position overloads the head itself, which becomes unbalanced about its transversal support axis. Furthermore, providing both a support rod welded to the head and a clamp which slides on said rod, involves considerable cost both in terms of manufacture and assembly.

SUMMARY OF THE INVENTION

The object of the present invention is therefore to provide a pressure roller support and adjustment device which is simplified compared with the known art and is therefore substantially less costly. This result is attained in that the support device consists of a plate in the form of a circular sector, from which a support arm for the pressure roller projects in a substantially tangential direction, said plate being mounted rotatable on a vertical pivot fixed to the upper mobile head assembly of the machine, and cooperating with position locking means, the roller being carried at the end of said support arm by a vertical rotation pin. In said plate there is also provided an arcuate aperture with its centre on the axis of rotation of said plate, and with which said locking means in the form of a bolt and nut cooperate, one of these two elements being fixed to said upper mobile head.

BRIEF DESCRIPTION OF THE DRAWINGS

Further characteristics and advantages of the device according to the present invention will be apparent from the description given hereinafter of a preferred embodiment thereof, shown by way of example on the accompanying drawings, in which.

DESCRIPTION OF THE PREFERRED EMBODIMENTS

Figure 1:
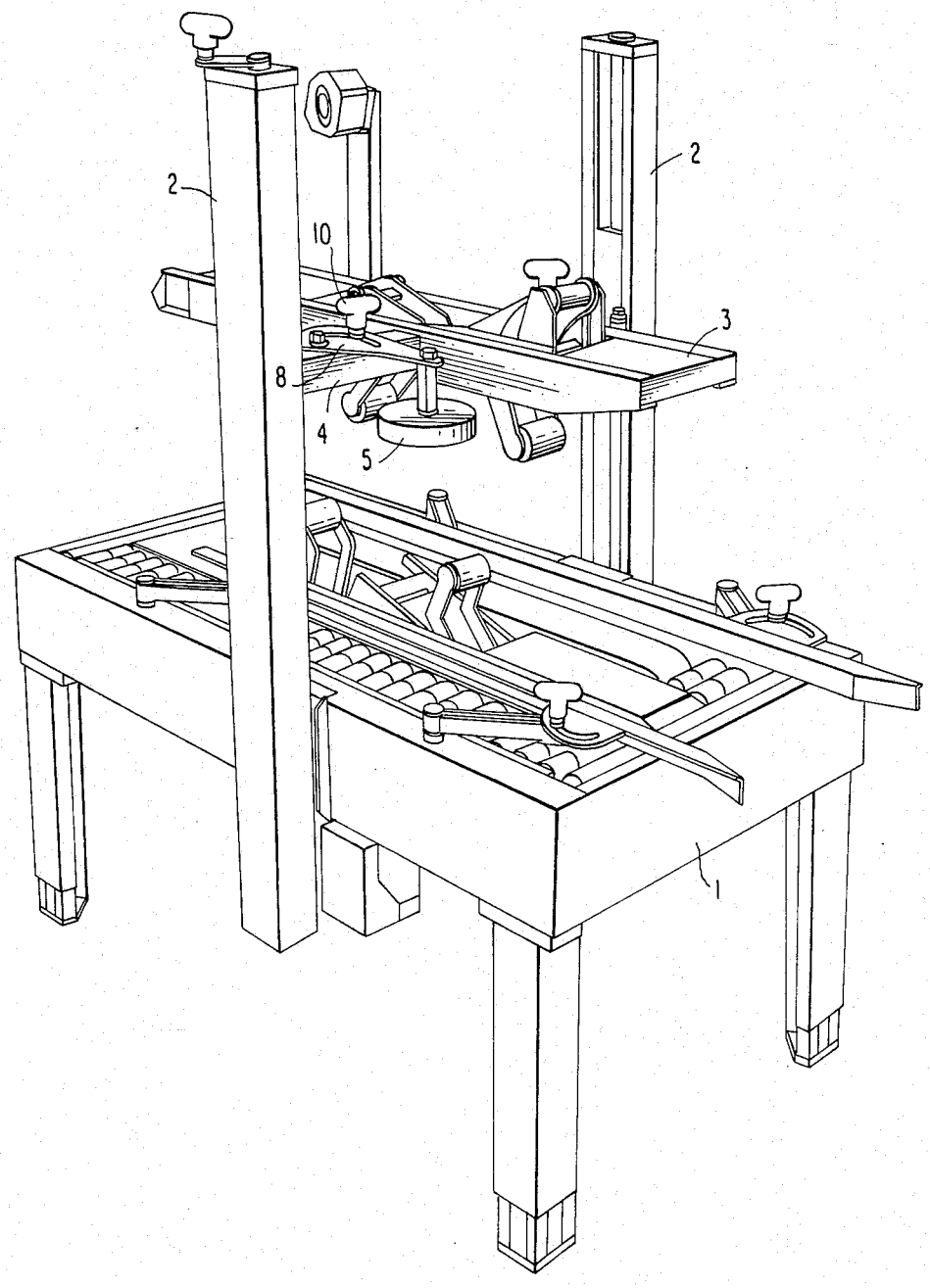
FIG. 1 is a diagrammatic, perspective view of the packaging machine, showing the use of the pressure roller device according to the invention.

As shown, the device according to the invention is applied to a packaging machine of the type shown diagrammatically in FIG. 1, comprising a bed 1, two lateral columns or uprights 2 projecting upwards from the bed 1, and an upper (guide and/or taping) head 3, fixed to a cross-member 4, which is slidable vertically along the columns 2.

Two lateral pressure rollers 5—only one of which is visible in FIG. 1—are associated with the assembly formed by the head 3 and cross-member 4, to guide and laterally retain, in known manner, the upper part of the box (not shown) which advances on the bed 1.

Figure 2:
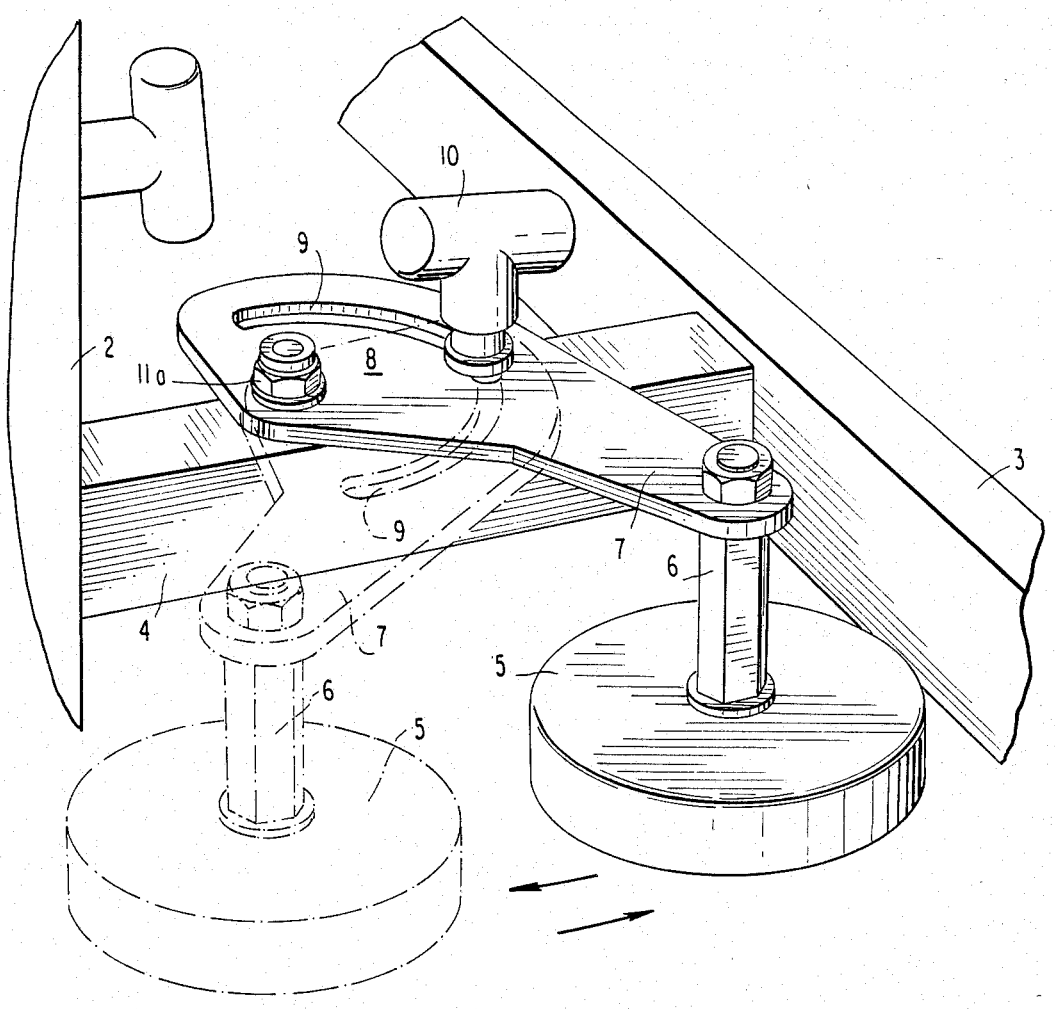
FIG. 2 is a perspective view of said device in two different working positions.

As can be better seen in FIG. 2, each of the two pressure rollers 5 is mounted rotatable on a vertical pin 6 fixed to the end of an arm 7 oscillating in a horizontal plane. The arm 7 is formed as an extension of a plate 8—obtained for example by blanking sheet metal—in the form of a circular sector.

The plate 8 is mounted rotatable through its centre about a fixed pivot connected to the assembly formed by the head 3 and cross-member 4. Furthermore, the plate 8 comprises an arcuate aperture 9 having its centre on the pivot of the plate 8 and with which cooperate position-locking means consisting for example of a wing nut 10.

Figure 3:
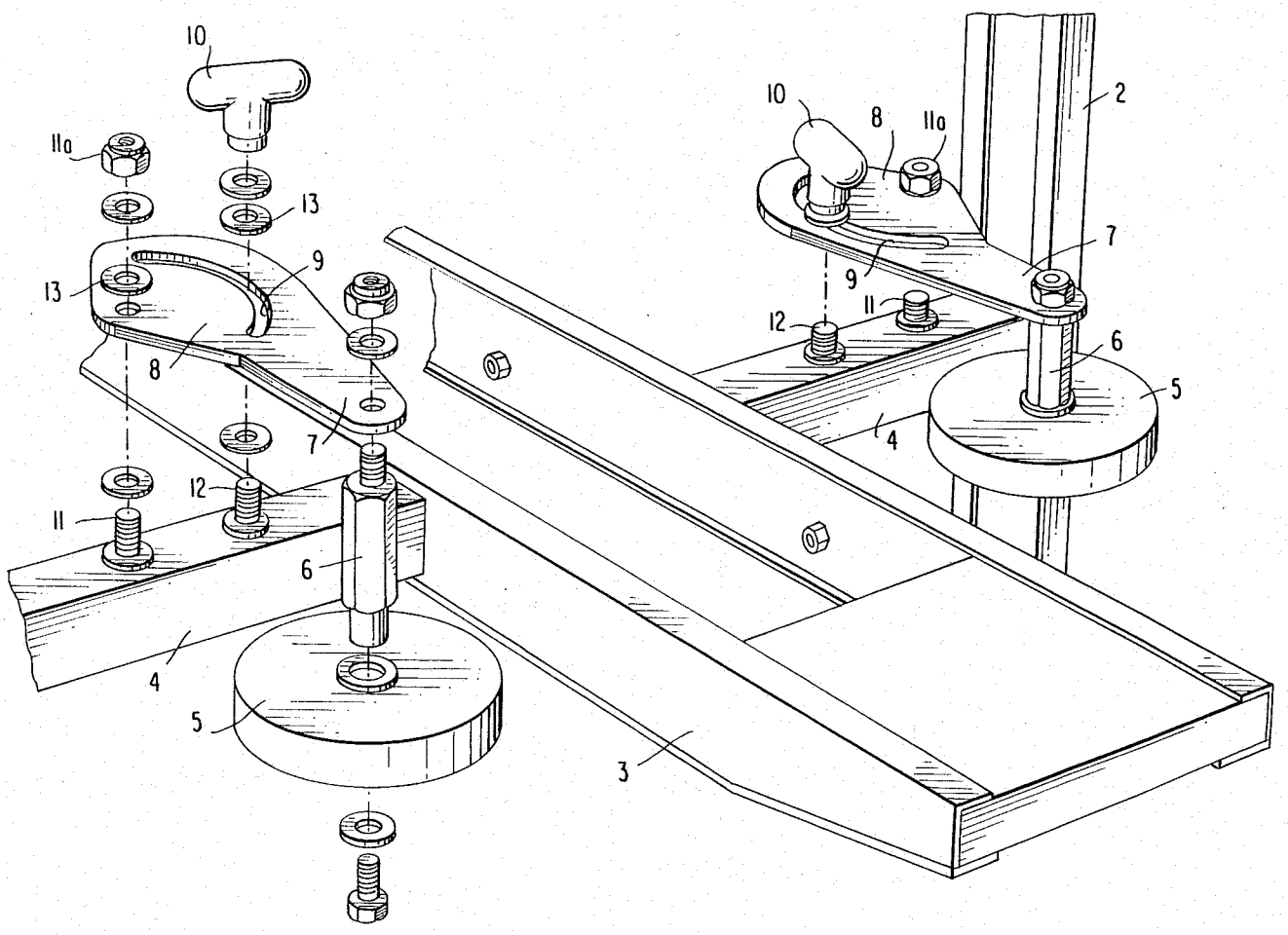
FIG. 3 is an exploded view of the device.

In the particular arrangement illustrated, the pivot for the plate 8 consists of a stud 11 projecting upwards directly from the cross-member 4 (see FIG. 3). A second stud 12, also fixed to the cross-member 4, passes through the aperture 9 to cooperate with the wing nut 10.

Preferably, the plate 7 is assembled on the studs 11 and 12 by interposing between these and the nut **11*a* or wing nut 10, or between the respective steel washers, supplementary nylon washers 13, the purpose of which is to prevent damage to the paint of the plate 8**, when this is swivelled for position-adjusting reasons.

The method of operation of the described device is apparent. After mounting the plate 8 on the studs 11 and 12, by engaging these latter in its central hole and aperture 9 respectively, and screwing without tightening the self-locking nut **11*a* and wing nut 10, the arm 7 is oscillated until the periphery of the roller 5 rests against the side of the box (previously positioned on the bed 1 for adjustment purposes). The wing nut 10 is then tightened to lock the plate 8 and arm 7** in position.

In this manner, the roller 5 can be moved into any intermediate position between the two end positions shown diagrammatically in FIG. 2, these end positions being defined by the width of the aperture 9.

It is apparent that a single plate 7-8 can be indifferently used either on the right hand or on the left hand side of the machine, both because the plate only has to be overturned to obtain specular symmetry, and because it does not matter whether the plate is mounted with its central hole on the outer stud 11 or on the inner stud 12, perfect position-adjustment being obtained in any case.

In addition to the extremely simple construction and assembly of the device according to the invention, this can advantageously be mounted directly on the cross-member 4 carrying the upper head 3, so as not to create unbalanced loading of said head. The arm 7 can of course be of any required length, so that the pin 6 and consequently the roller 5 can be located in a position which is as rearwards as required.

Such a simplified support device can obviously also be mounted directly on the head 3 in those cases in which such a solution is more suitable.

I claim:

1. In a packaging machine for cardboard boxes, comprising means supporting the boxes and two lateral uprights (2) along which vertically slide the ends of a horizontal cross-member (4) supporting a taping head

(3), a lateral retention and guiding device for the boxes comprising a plate (8) from which a support arm (7) projects, said plate being mounted oscillating on a vertical pivot (11) fixed to the cross-member (4) supporting the head (3), a pressure roller (5) mounted freely rotating on a vertical pin (6) carried at the free end of said support arm (7), said plate having an arcuate slot (9) with its center on the axis of rotation of said plate, and a bolt (12) and nut (10) one of which is fixed to said cross-member supporting the head, the bolt extending through said slot.

2. Apparatus as claimed in claim 1, in which said bolt is fixed to said cross-member.

3. Apparatus as claimed in claim 1, said plate being in the form of a circular sector.

* * * * *